US009763529B2

(12) United States Patent
Abebe

(10) Patent No.: US 9,763,529 B2
(45) Date of Patent: Sep. 19, 2017

(54) ROD-TYPE ORGANIZER AND DISPLAY UNIT FOR CONTINUOUS PERSONAL ITEMS

(71) Applicant: Tsigie Abebe, Ellicott City, MD (US)

(72) Inventor: Tsigie Abebe, Ellicott City, MD (US)

( * ) Notice: Subject to any disclaimer, the term of this patent is extended or adjusted under 35 U.S.C. 154(b) by 0 days.

(21) Appl. No.: 15/043,557

(22) Filed: Feb. 13, 2016

(65) Prior Publication Data

US 2016/0235220 A1 Aug. 18, 2016

Related U.S. Application Data

(60) Provisional application No. 62/115,835, filed on Feb. 13, 2015.

(51) Int. Cl.

| | |
|---|---|
| ***A47F 7/02*** | (2006.01) |
| ***A47G 29/08*** | (2006.01) |
| ***A47F 7/024*** | (2006.01) |
| ***A47F 5/00*** | (2006.01) |
| ***A47F 5/14*** | (2006.01) |

(52) U.S. Cl.

CPC ..... *A47G 29/08* (2013.01); *A47F 5/0006* (2013.01); *A47F 5/14* (2013.01); *A47F 7/02* (2013.01); *A47F 7/024* (2013.01)

(58) Field of Classification Search

CPC ..... A47J 29/00; A47G 29/10; A47G 25/0692; A47G 25/74; A47F 7/02; A47F 7/022; A47F 7/024; A47F 5/01; A47F 5/13; A47F 5/14; A47F 5/0006; A47F 7/12; A47F 7/17; A47F 7/19; A47F 5/0807; A47F 3/002; A47F 5/0861; A47B 55/02; A47B 61/003; A47H 1/02; A47H 2001/021; A47H 2001/0215; A47K 10/04; A47K 10/10; B42F 13/12; B42F 13/24; B42F 13/22; E05B 73/00; E05B 69/006; Y10T 403/59; Y10T 403/591; Y10T 24/45319; E05C 17/56; E05C 19/16; E05C 19/168; F16B 45/02

USPC ..... 211/85.2, 175, 181.1, 123, 105.1, 124, 211/89.01, 100, 125, 85.31, 85.5, 85.3, 4, 211/7; 206/6.1; 403/321, 322.1; 402/34, 402/36; 292/251.5; 24/303

See application file for complete search history.

(56) References Cited

U.S. PATENT DOCUMENTS 270,134 A * 1/1883 Schmidt ..... A47B 53/00 16/87.4 R
274,688 A * 3/1883 Wicks ..... B42F 13/24 402/35

(Continued)

*Primary Examiner* — Jennifer E Novosad
(74) *Attorney, Agent, or Firm* — Michael J. Foycik, Jr.

(57) ABSTRACT

An organizer has a rod-like support serving as a jewelry organizer, holder, and/or display device closed at each end, and having a closing mechanism which can be opened and closed to allow addition or removal of items from the rod-like support. The items can include bracelets, bangles, watches, necklaces, rings and the like. The rod-like storage device has two L-shaped paired rods with an opening therebetween. The closing mechanism in a preferred embodiment includes a slot in one of the rods and a mating projection in the other one of the rods. This allows items to be easily slipped onto the rod once it has been opened and maintained on the storage rod when the rod is closed. In one embodiment of the device a paired storage rod in two portions is mounted on an elongated strip.

9 Claims, 15 Drawing Sheets

(56) References Cited

U.S. PATENT DOCUMENTS 594,420 A * 11/1897 Noble ..... B42F 13/24 402/34
808,248 A * 12/1905 Morden ..... B42F 13/16 402/27
1,206,769 A * 11/1916 Wheary ..... E05B 69/006 211/7
2,287,418 A * 6/1942 Dudley ..... A47F 5/02 211/123
2,951,589 A * 9/1960 Dudley ..... A47F 7/12 211/59.1
3,785,740 A * 1/1974 Strong ..... B42F 13/18 402/29
D270,220 S * 8/1983 Cuminale ..... D6/682.4
4,462,497 A * 7/1984 Maule ..... A47F 5/04 211/59.1
4,474,300 A * 10/1984 Entis ..... A47F 5/0861 211/4
4,775,053 A * 10/1988 Geiger ..... A47F 7/02 211/85.2
4,811,853 A * 3/1989 Mead ..... B65D 85/185 206/279
5,018,627 A * 5/1991 Moore ..... A47G 25/0692 206/291
D352,190 S * 11/1994 Tucker ..... D6/681.1
5,577,304 A * 11/1996 Simond ..... F16B 45/02 24/588.1
6,158,578 A * 12/2000 Greiner ..... A47F 7/02 206/6.1
6,976,596 B2 * 12/2005 Brooks ..... F24C 15/16 211/153
D532,994 S * 12/2006 Rice ..... D6/682.6
7,891,506 B2 * 2/2011 Kornowski ..... A45C 11/16 211/163
8,141,721 B2 * 3/2012 Harris-Bowman .... A45C 11/16 206/6.1
2002/0179546 A1 * 12/2002 McMurray ..... A47F 5/0861 211/4
2005/0194334 A1 * 9/2005 Johnson ..... A45D 8/36 211/85.2
2009/0158899 A1 * 6/2009 Eisenbraun ..... A45C 15/00 81/3.09
2011/0175376 A1 * 7/2011 Whitens ..... B60R 7/06 292/251.5
2015/0257551 A1 * 9/2015 Trainor-Smith ..... A47F 7/02 211/85.2
2016/0235220 A1 * 8/2016 Abebe ..... A47G 29/08

* cited by examiner

ROD-TYPE ORGANIZER AND DISPLAY UNIT FOR CONTINUOUS PERSONAL ITEMS

CROSS-REFERENCE TO RELATED APPLICATIONS

This application claims the benefit of applicant's prior application 62/115,835, Open and Close, Bracelet, Watch and Ring Organizer or Display, filed on Feb. 13, 2015. This application incorporates by reference U.S. Provisional Patent application 62/115,835, Open and Close Bracelet, watch and ring organizer or display, filed on 13 Feb. 2015.

STATEMENT REGARDING FEDERALLY SPONSORED RESEARCH OR DEVELOPMENT

Not Applicable.

SEQUENCE LISTING

Not Applicable.

Personal items or accessories, such as rings, bracelets, bangles, necklaces, watches and the like are often difficult to store and retrieve. One of the most common ways to store and display these personal items involves slipping them over an open rod-like storage device, often a simple wooden peg with one free end and with the other end secured to a door. Another common method for storage of personal items is the classic jewelry chest. Many people accumulate large numbers of these personal items and convenient, safe storage is always something of a problem.

It is especially difficult to conveniently store bracelets or bangles [a rigid bracelet] in a jewelry chest as these items tend to be considerably larger than other personal items such as earrings, rings or even watches. In addition, bracelets and bangles are often of more delicate construction. Many if not most, bracelets, bangles, rings and watches are continuous—that is, they comprise continuous, closed circles or loops and cannot be opened or closed. This construction can cause problems when attempting to secure these items over a closed rod-type storage unit—that is, a rod-type storage unit which is closed at each end. Even personal items that can be opened and closed can be difficult to secure on a rod-type storage unit since many of these items tend to be rather delicate and fragile.

BACKGROUND OF THE INVENTION

A wide variety of devices have been provided over the years to conveniently store and retrieve personal items. These range from simple pegs with an open or free end and with the other end secured to a convenient surface such as the back of a closet door. In addition cup hooks screwed into a board, wall or door and also quite common storage devices. And, of course, the classic jewelry chest has been used for centuries as a jewelry storage device. Pegs or rods have to be individually mounted to the desired surface. In addition, the personal items may easily be dislodged from the peg or rod. These same problems occur when using cup hooks for storage. In addition, these personal items are often fragile and can easily be damaged or destroyed by a metal cup hook. It is also easy to dislodge a personal item from one cup hook when removing another personal item from an adjacent cup hook. Jewelry chests can also be problematic in that it is difficult to store larger items such as bracelets, bangles and necklaces in a jewelry chest because of size restraints. It is not unusual to have a bracelet or bangle exceed 4 inches in diameter and an inch in width. In addition, bracelets and bangles are often made of very thin metal and, consequently rather fragile. The same could be said of earrings, since many of them are also rather large and delicate. The size of a personal item can make it difficult to conveniently store the personal items in the typical jewelry box. In addition, it is always difficult to avoid damaging larger personal items when opening and closing drawers and/or doors in a jewelry box.

It is often quite convenient to store bracelets, bangles, watches and rings on a rod-like storage device. If the rod is securely mounted at one end and free at the other, the bracelet, bangle, watch or ring may simply be slipped onto the free end of the rod for storage and then removed when desired. The rod-like storage device often has to be mounted at an angle or provided with an enlarged tip to keep the personal item on the rod-like storage device. In other words, such rods are often generally vertical or mounted at a significant angle to the horizontal such that gravity will assist in keeping the personal items on the rod-like storage device.

Various devices have been provided in the prior art to resolve these issues and provide for more convenient storage and retrieval of personal items. For example, U.S. Pat. No. 6,691,118 to Phillips discloses an accessory holding device for holding a plurality of accessory devices such as hair clips, bows, barrettes, ties and other hair accessories as well as various items of jewelry. The device comprises a plurality of rod-like members closed at both ends which provide storage for items which may be clipped onto the rod-like storage members. In addition, open-ended rods are provided for slip-on storage of continuous items such as bracelets, bangles and/or rings. Internal attachment members, drawers, and retainers are provided to accommodate a wide array of items. The device may be relatively open, formed only with a base and sides, or be enclosed with top, back, and face plates, in differing embodiments. The device may also be provided with a mounting device so that the entire device may be hung on the wall, the back of a door, or other surfaces. The Phillips device does not provide for the rod-like storage members to open such that continuous items like bracelets, bangles, rings and watches may be easily mounted on and/or removed from the rod-like storage members.

U.S. Pat. No. 6,158,578 to Greiner discloses a jewelry holder with at least two movable and interchangeable stands and a base. The base may be in the form of a box with a slidable drawer in which a ring holder platform may be inserted. The base has a plurality of grooves to receive jewelry stands. The jewelry stands have various configurations to hold earrings, necklaces and bracelets. According to a third aspect of the invention there is provided a ring holder having a platform and a plurality of mounds integrally formed on the platform. The mounds have a shape that allows rings to be stored thereon. One embodiment of the Greiner jewelry holder provides open-ended rod-like storage members for storage of continuous items like bracelets, bangles, rings, or watches; however, the Greiner holder does not does not provide for the rod-like storage members to be closed at each end so that items mounted thereon cannot fall off the rod-like storage member. Nor does the Greiner holder provide for rod-like storage members which can be opened and closed such that continuous items like bracelets, bangles, rings and watches may be easily mounted on and/or removed from the rod-like storage members.

U.S. Pat. No. 7,891,506 to Kornowski discloses a jewelry holder and display comprising an upstanding post the lower end of which is secured to a circular base which, in turn, is rotatably supported on a larger diameter primary base such that the upstanding stem can be readily rotated about its longitudinal axis. The stem supports radially located extending pegs and also supports at its upper end a generally cylindrical cup-shaped receptacle member having a plurality of radially extending pegs selectively secured to its outer circumference for supporting jewelry items such as bracelets, bangles, watches, necklaces and the like. All of the Kornowski rod-like support members are pegs mounted at one end and open at the other such that jewelry items can fall off the peg. The Kornowski holder does not provide for rod-like storage members which can be opened and closed such that continuous items like bracelets, bangles, rings and watches may be easily mounted on and/or removed from the rod-like storage members.

U.S. Pat. No. 4,775,053 to Geiger discloses a jewelry rack or holder comprising a framework of attractive vertical and horizontal wooden bars. The horizontal bars are provided with hooks for hanging small items such as rings and necklaces. In one embodiment, the vertical bars are provided with small drilled holes for receiving the shafts of pierced-type earrings. In another embodiment, a block of plastic material covered with cloth is utilized to removably secure the shafts of pierced-type earrings. The jewelry rack may be hung from a wall or it may include removable stands for supporting it in an upright attitude on a horizontal surface. The Geiger jewelry rack does not provide for rod-like storage members which can be opened and closed such that continuous items like bracelets, bangles, rings and watches may be easily mounted on and/or removed from the rod-like storage members.

U.S. Pat. No. D270,220 to Cuminale discloses an ornamental design for a bracelet display stand. The Cuminale invention provides for a base with two horizontal rods mounted on supports extending upwards from the base. The rods are closed at each end and appear to be capable of supporting continuous jewelry items like bracelets or bangles. Since the Cuminale patent is a design patent, there is no written description of how the apparatus is made or intended to be used other than a very brief description of the drawings. There is simply no information provided in Cuminale as to how bracelets, bangles, etc are inserted onto the display stand.

SUMMARY OF THE INVENTION

The present invention provides for a rod-like jewelry organizer, holder and/or display closed at each end to maintain the items on the holder/display unit. In its most basic form, the invention comprises two paired storage rods which are cantilevered to each end of an elongated mounting strip. The open end of each paired rod extends towards the middle of the elongated strip. A sliding cover is secured to one of the paired rods and permits the rods to be secured together into a single elongated rod when the cover is in the closed position. When the cover is in the open position, a gap exists between the paired rods permitting continuous items of jewelry to be slipped onto the storage rods. The invention will provide for convenient storage and retrieval of a large number of continuous items of jewelry such as bracelets, bangles, watches, necklaces, rings and the like. This is accomplished by providing a rod-like storage device which is closed at both ends of the rod so that items stored on the rod cannot fall off the rod, and providing the device with an opening means so that items can easily be slipped onto the rod once it has been opened. Although the invention is directed towards the storage and/or display of continuous personal items of jewelry it should be understood that the invention is equally useful for storing non-continuous personal items—items that can themselves be opened or closed. The invention may also be used for the storage and/or display of other items, for example rubber bands, O-rings or the like.

DETAILED DESCRIPTION OF THE INVENTION

Figure 1:
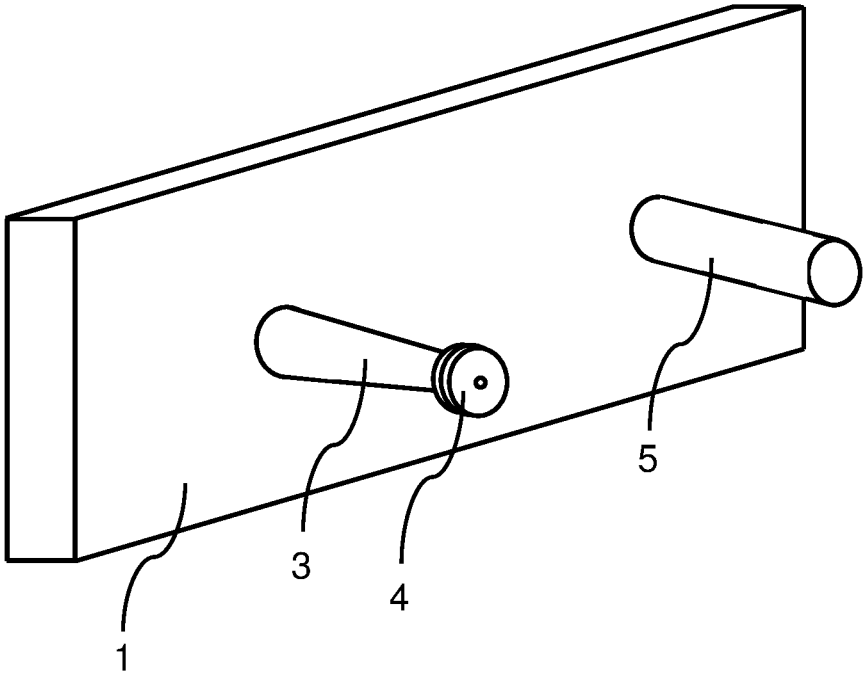
Fig. 1 Prior Art
FIG. 1 is a view of a typical prior art peg storage device for suspending continuous personal items.

Typical prior art, peg-type and rod-type storage devices are shown in FIG. 1, comprising a mounting board 1 with peg 3 and rod 5 secured thereon. Board 1 would normally be secured to any suitable vertical surface [not shown]. Continuous personal items such as bracelets, bangles, rings or watches are merely slipped over the open end of peg 3 to store and/or display them. Peg 3 is tapered and has an enlarged portion 4 at the free end to assist in maintaining the personal items on the peg. An even more simple example of a prior art storage device is rod 5 which is mounted at one end to board 1. Rod 5 is not tapered. Again, as for peg 3, the continuous personal items are merely slipped over the open end of peg 5. Since there is nothing at the free end of rod 5 to aid in keeping the continuous personal items on the rod, the rod will often be mounted at a slight upward angle [not shown in the drawings] to aid in maintaining the continuous personal items on rod 5.

Figure 2:
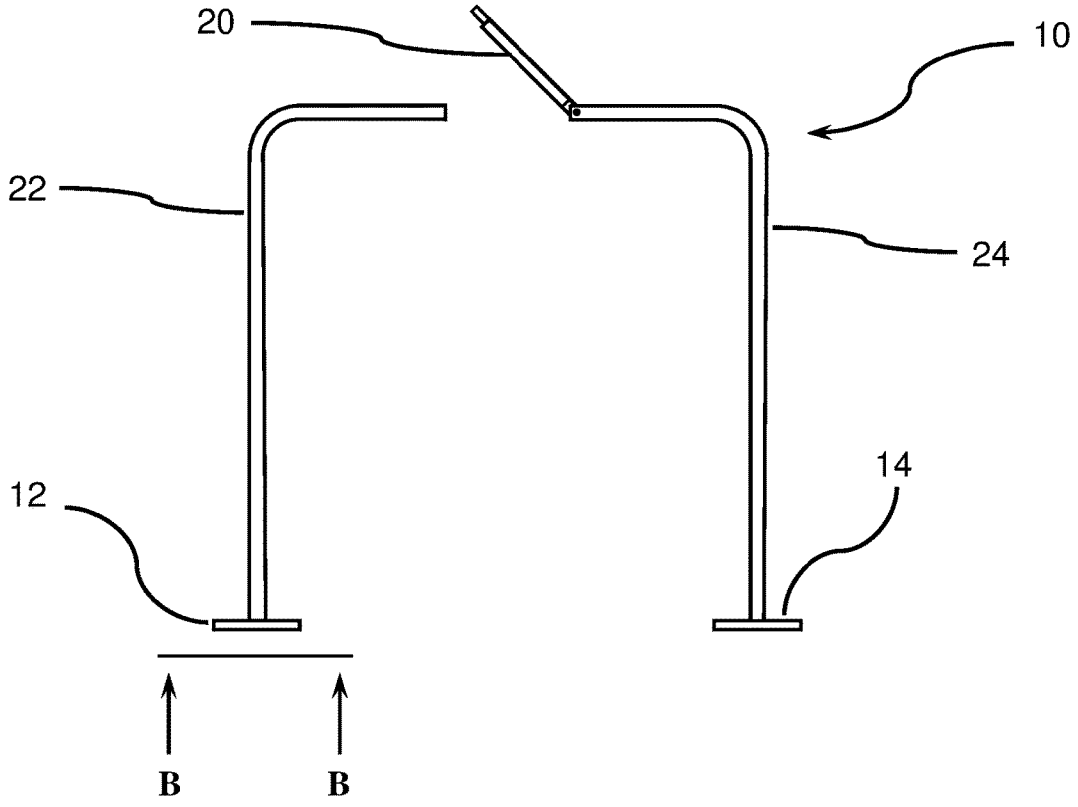
FIG. 2 is a side view of a first embodiment of the invention.

A first embodiment of the invention is shown in FIG. 2. Storage device 10 is shown in a side view and comprises a left-hand "L"-shaped storage rod 22 with an enlarged mounting area 12 at one end. Storage device 10 also comprises a right-hand "L"-shaped storage rod 24 with an enlarged mounting area 14 at one end and a closing mechanism 20 pivotally mounted to the other end of storage rod 24. Storage rods 22 and 24 can be of any desired cross-section such as square, oval, circular, irregular and etc. Storage rods 22 and 24 can be of solid construction but can also be hollow tubes for lightness. Rods 22 and 24 are of substantially constant cross-section. This makes it easier to slide continuous personal items when mounted on the storage device 10. Storage device 10 may be made of any suitable material, such as a polymer or metal.

Figure 3:
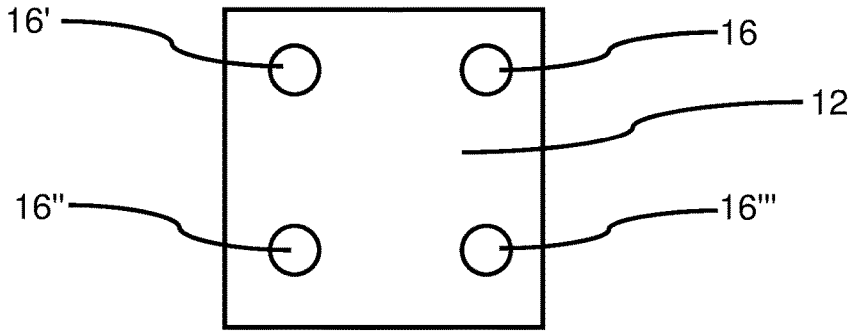
FIG. 3 is a plan view taken along section B-B of FIG. 2.

FIG. 3 shows a plan view of enlarged mounting area 12 taken from the perspective of arrows B-B of FIG. 2. Enlarged mounting area 12 is roughly square and has multiple holes 16, 16', 16" and 16'" bored therein. These holes are sized to accept a mounting screw [not shown in FIG. 3] to permit storage device 10 to be secured to a convenient surface.

Figure 3A:
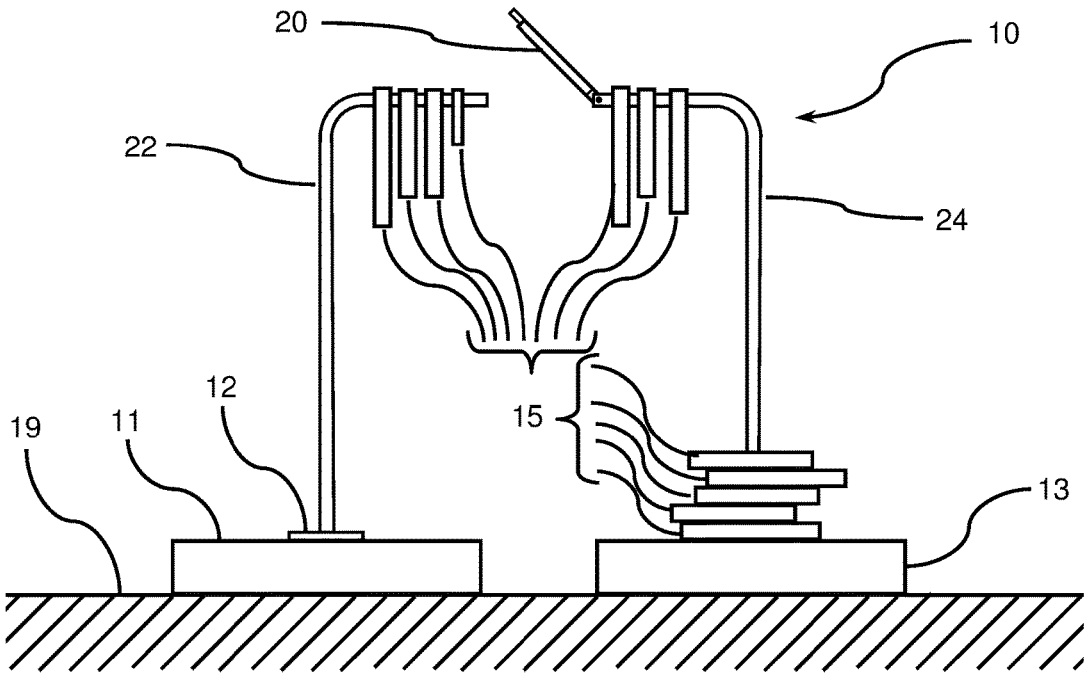
FIG. 3A is a side view showing the embodiment of FIG. 2 mounted on individual stands with continuous personal items stored thereon.
Figure 5:
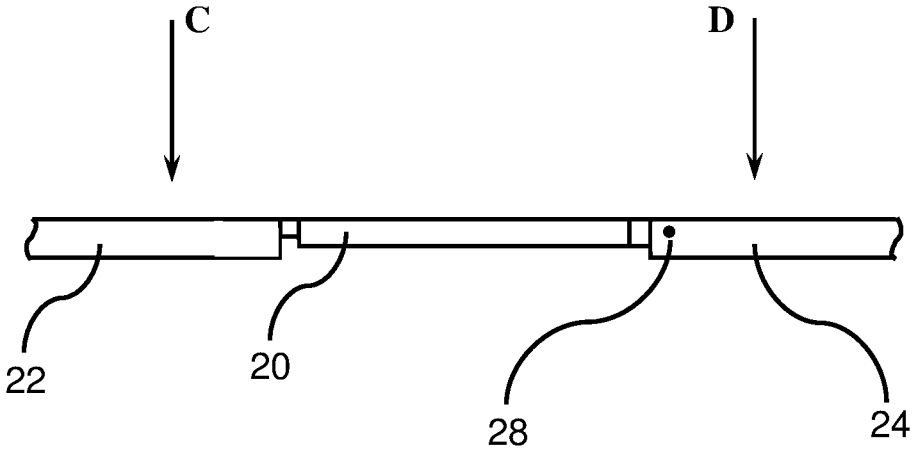
FIG. 5 is an enlarged detail side view of the closing mechanism shown in the area A of FIG. 4.

FIG. 3A shows a side view of the storage device 10 of FIG. 2 with "L"-shaped storage rod 22 being mounted on a base 11. "L"-shaped storage rod 24 is mounted on a separate base 13. The material that bases 11 and 13 are made from is selected such that each "L"-shaped storage rod 22 and 24 will stand erect on its own. To use the storage device 10 mounted on bases 11 and 13 each base-mounted storage rod 22 and 24 is placed upon a suitable surface 19. The storage rods 22 and 24 are then moved into alignment such that closing mechanism 20 may be secured in the slot [not shown in FIG. 3A] in storage rod 22. In this configuration, continuous personal items 15 may be inserted onto storage device 10 by moving closing mechanism 20 to the open position shown in FIG. 3A. When all of the desired continuous personal items are inserted onto storage device 10, the closing mechanism 20 will be moved to the closed position where the free end of closing mechanism 20 is secured to storage rod 22. As is shown in FIG. 5, closing mechanism 20, when in the closed position, forms a smooth, continuous top surface with storage rods 22 and 24 such that bracelets, etc. can be easily slid from one storage rod to the other. In addition, when it is desired to remove a particular personal item, it is not necessary to remove any other items to remove the desired item—in contrast to many other prior art jewelry organizer designs.

Figure 4:
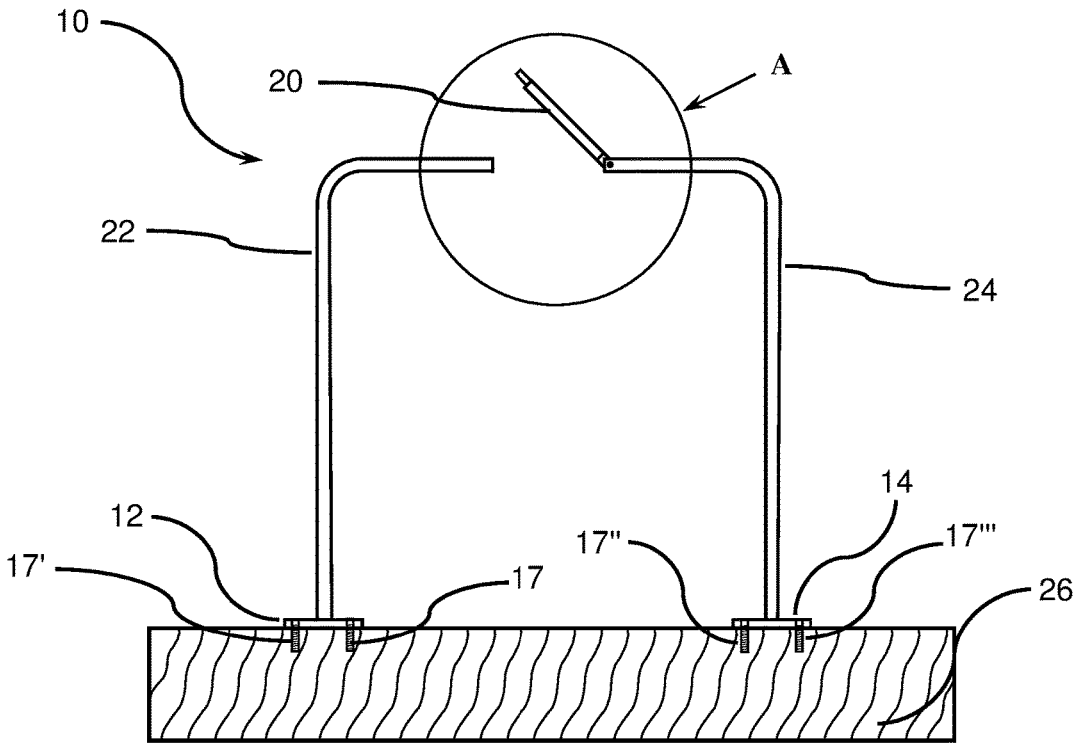
FIG. 4 is a side view of the embodiment of FIG. 2 mounted on a wooden support.
Figure 7:
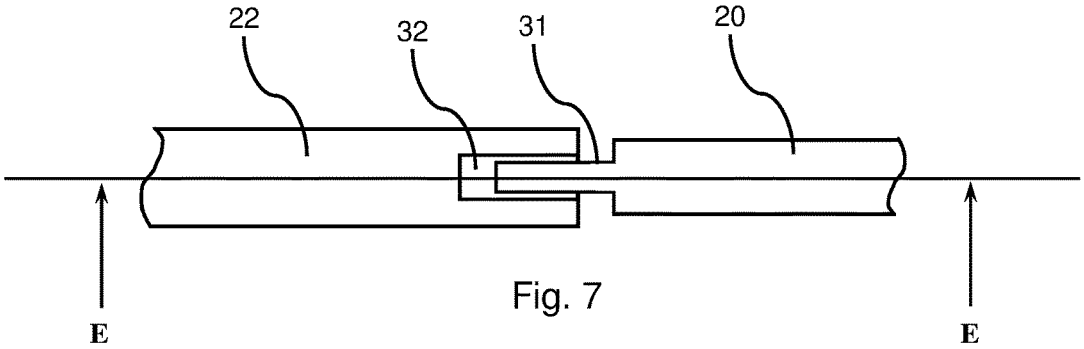
FIG. 7 is another enlarged detail plan view of the closing mechanism as shown from the perspective of arrow C in FIG. 5.

FIG. 4 shows a side view of the storage device 10 mounted onto a support block 26 by screws 17, 17', 17" and 17'". To use storage device 10 to store continuous personal items such as bracelets, bangles, necklaces, rings and/or watches, the left-hand storage rod 22 and right-hand storage rod 24 are secured to any convenient surface such as wooden block 26 as shown in FIG. 4. In FIG. 4, screws 17, 17', 17" and 17'" are used in cooperation with the holes in enlarged mounting areas 12 and 14 to secure the storage rods 22 and 24 to wooden support block 26. It is to be understood that the support rods 22 and 24 have to be secured to wooden support block 26 in an aligned manner and spaced appropriately to permit closing mechanism 20 to cooperate with and be received in slot 32 of storage rod 22 as shown in FIG. 7, below, to open and close storage device 10 such that continuous personal items may be inserted and removed from storage device 10. The support block is shown in FIG. 4 as being made of wood, but any other suitable material could be used. For example, the support block could be metal, a polymer, or stone. In these situations, a different fastening means might have to be used to secure enlarged mounting areas 12 and 14 to the support block, for example, welding, or an adhesive.

FIG. 5 shows a side view of the closing mechanism as shown in area A of FIG. 4. Storage device 10 is closed by closing mechanism 20 which is a rod, pivotally mounted to one end of storage rod 24 and received [in the closed position as shown herein] in a slot [not shown in FIG. 5] in the end of storage rod 22. Member 20 is pivotally mounted to storage rod 24 by pin 28. It should be noted that when closing mechanism 20 is moved to the closed position, there the top surface of closing mechanism 20 aligns with the top surfaces of storage rod 22 and storage rod 24 such that a continuous surface is formed across the gap between storage rods 22 and 24. This construction makes it easy to slide continuous personal items from one storage rod to the other, and it makes usage of the storage device safer since many continuous personal items such as bracelets, bangles, rings, necklaces and/or rings are rather fragile. Thus, this construction, lessens the risk of a personal item being snagged and damaged in using the storage device.

Figure 6:
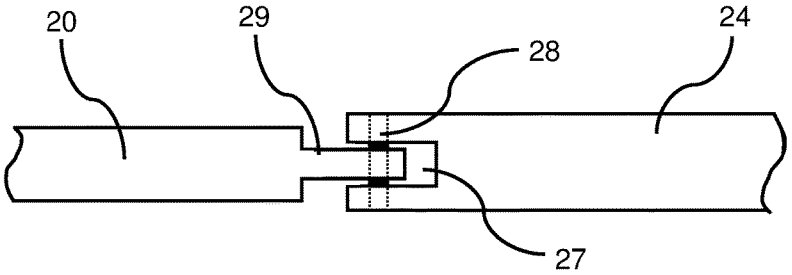
FIG. 6 is enlarged detail plan view of the closing mechanism as shown from the perspective of the arrow D in FIG. 5.

FIG. 6 shows a plan view of the closing mechanism shown from the perspective of arrow D in FIG. 5. Storage rod 24 has a slot 27 cut in the end opposite from the enlarged mounting area 14. Closing mechanism 20 has a reduced size portion 29 on the right-hand portion thereof. This portion 29 is bored for a hole which will accept pin 28 to pivotally mount the closing mechanism 20 to storage rod 24.

FIG. 7 shows a plan view of the closing mechanism of FIG. 5 from the perspective of arrow C. Storage rod 22 has a slot 32 cut at the end thereof opposite from enlarged mounting area 12. Closing mechanism 20 has a reduced size portion 31 on the left-hand portion of the closing member. This portion 31 is sized to fit within slot 32. Portion 31 is secured within slot 32 when in the position shown in FIGS. 7 and 8.

Figure 8:
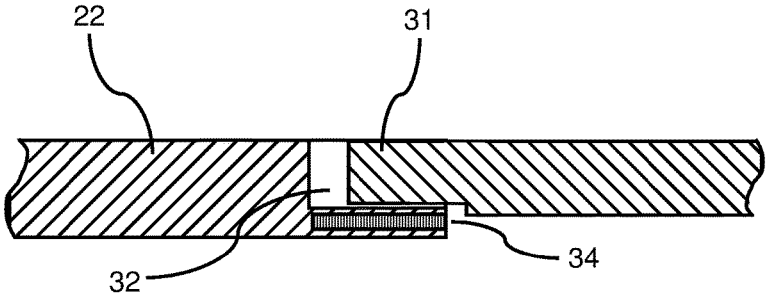
FIG. 8 is a cross-section enlarged detail view of the closing mechanism along the section E-E of FIG. 7.

FIG. 8 shows a cross-sectional view along section E-E of FIG. 7 and illustrates how portion 31 is secured in slot 32. Reduced size portion 31 is made from a ferrous material and is held in the position shown in FIG. 8 by means of a magnet 34. Other mechanisms [not shown in the drawings] may be used to secure portion 31 within slot 32 in the closed position shown in FIGS. 7 and 8. For example, a spring-loaded, ball-type detent cooperating with a depression in portion 31 could be used to secure portion 31. Indeed, any mechanism that is relatively inexpensive and simple in operation could be used to secure portion 31.

Figure 9:
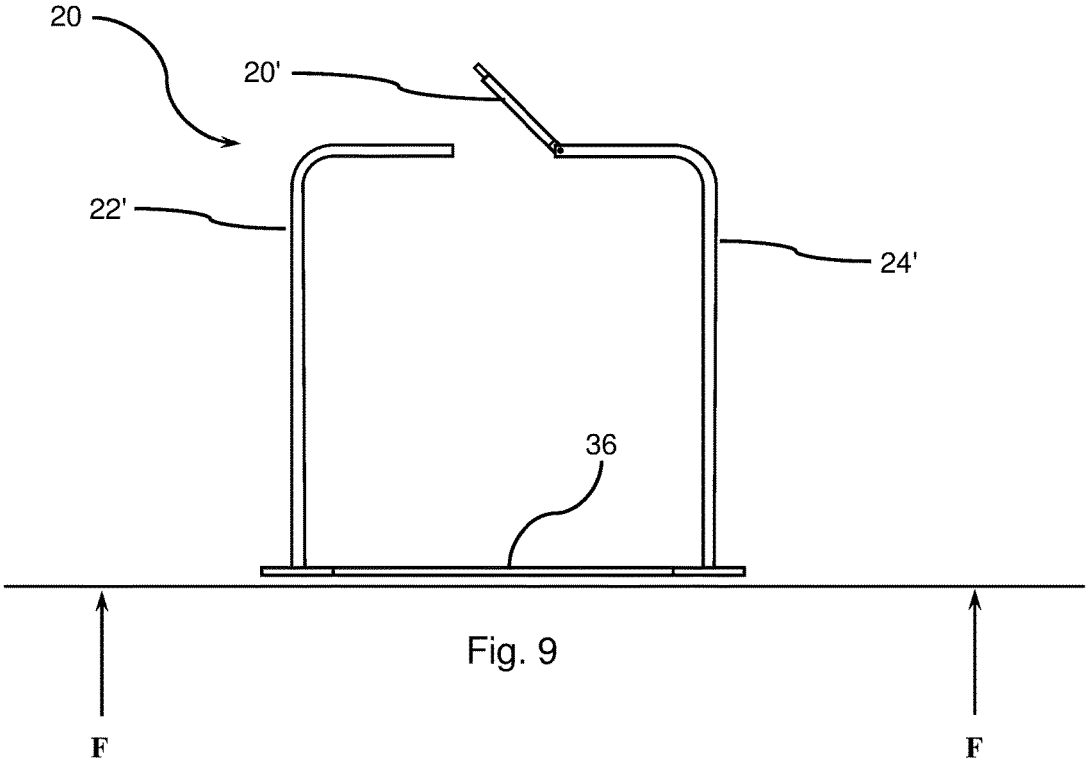
FIG. 9 is a side view of a second embodiment of the invention.

FIG. 9 shows a side view of the second embodiment of the invention. Storage device 20 is similar to storage device 10 of FIGS. 2-8 except it is mounted on a continuous strip 36 and assembled into a single unit—unlike storage device 10. Storage device 20 comprises a left-hand storage rod 22' secured at one end thereof to the left-hand portion of continuous strip 36 with the opposite end of storage rod 22' being freely supported. Right-hand storage rod 24' is secured at one end thereof to the right-hand portion of continuous strip 36 with the opposite end of storage rod 24' being freely supported. Closing mechanism 20' is pivotally mounted to the free end of right-hand storage rod 24'

Figure 10:
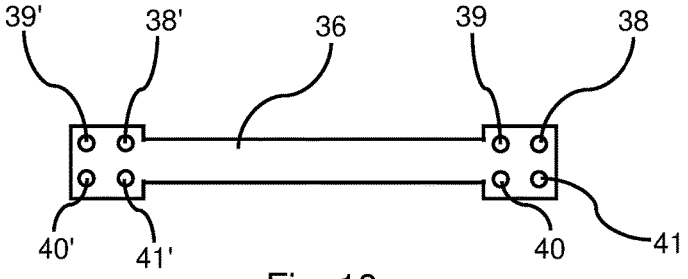
FIG. 10 is a view taken from the perspective of arrows F-F of FIG. 9.

FIG. 10 shows a plan view from the perspective of arrows F-F in FIG. 9 and illustrates how continuous strip 36 may be used to mount storage device 20 to a convenient surface. Continuous strip 36 has a series of screw-mounting holes [38, 39, 40, 41, 38', 39', 40' and 41'] bored in the right-hand and left-hand ends thereof. Screws [not shown in FIG. 10] may be used in cooperation with the screw-mounting holes to secure storage device 20 to any convenient surface.

Figure 11:
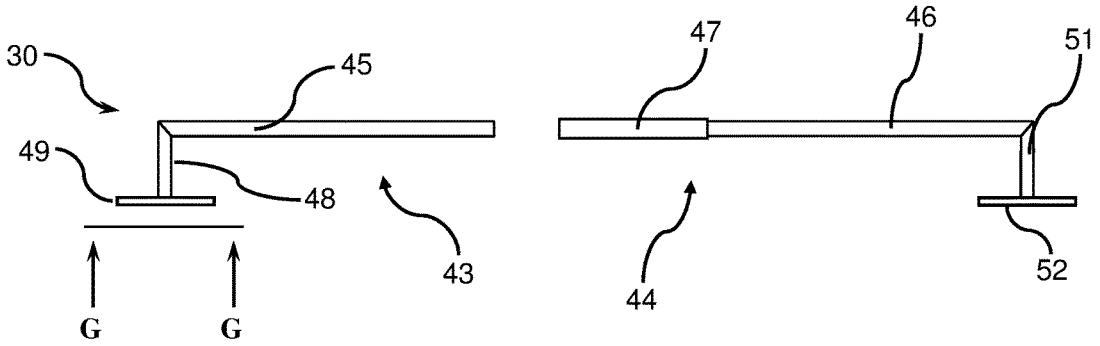
FIG. 11 is a side view of a third embodiment of the invention.

FIG. 11 shows a side view of a third embodiment of the invention. Storage device 30 comprises separate left-hand and right-hand generally "L"-shaped storage rods, 43 and 44 respectively. Left-hand storage rod 43 comprises a generally horizontal leg 45 and a generally vertical leg 48. Leg 48 is secured at one end to enlarged mounting area 49 with the other end thereof being joined to the left-hand end of horizontal leg 45. The right-hand end of horizontal leg 45 is freely supported. Right-hand storage rod 44 comprises a generally horizontal leg 46 and a generally vertical leg 51. Leg 51 is secured at one end to enlarged mounting area 52 with the other end thereof being joined to the right-hand end of horizontal leg 46. The left-hand end of horizontal leg 46 is freely supported. The closing mechanism for storage device 30 comprises a sliding cover 47 which is slidably secured to the left-hand end of horizontal leg 46. Sliding cover 47 is a hollow cylinder whose inside diameter is slightly larger than the outside diameter of horizontal legs 45 and 46. It should be noted that the rods comprising legs 45, 46, 48 and 51 are all of constant cross-section. When the cross-section chosen for these legs is circular, this would mean that these legs would be of constant cross-section.

Figure 12:
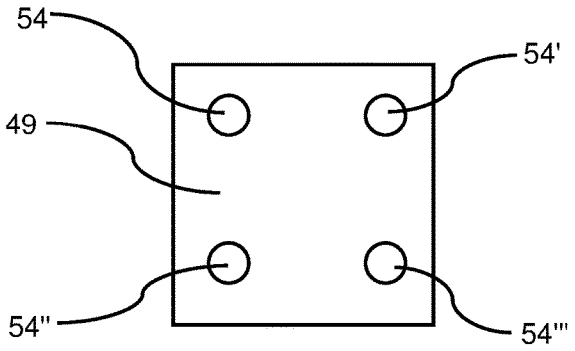
FIG. 12 is a plan view taken from the perspective of arrows G-G of FIG. 11.
Figure 13:
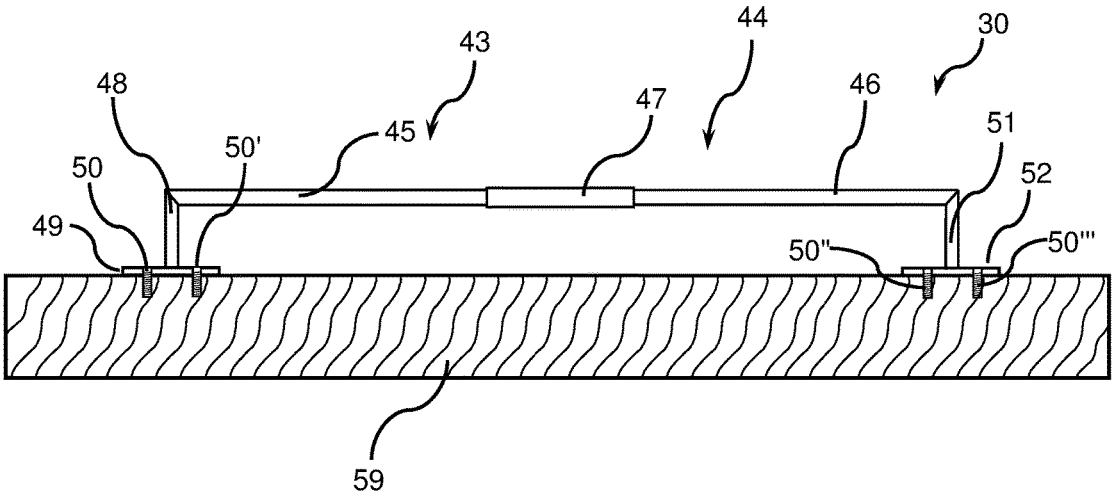
FIG. 13 is a side view of the embodiment of FIG. 11 mounted on a wooden support member.

The third embodiment of the invention as shown in FIG. 11, like the embodiment shown in FIG. 2, can be mounted to any convenient support. Both "L"-shaped support rod 43 and 44 may have a support base much as bases 11 and 13 shown in FIG. 3A. An alternate construction would be to have a single support base large enough to secure both support rod 43 and 44 such as wooden block 59 as shown in FIG. 13 for use. The means used to mount storage device 30 to the support are screws or like fasteners cooperating with holes in enlarged mounting areas 49 and 52. A plan view of enlarged mounting area 49 is shown in FIG. 12, from the perspective of arrows G, G in FIG. 11. This view shows mounting holes 54, 54', 54" and 54'" bored in enlarged mounting area 49. It should be noted that support base 59 may be made of materials other than wood. Indeed, a number of suitable materials could be used. A few examples of suitable materials are metal, a polymer, or stone.

FIG. 13 shows a side view of the storage device 30 mounted for use. To use storage device 30 to store continuous personal items such as bracelets, bangles, necklaces, rings and/or watches, the left-hand storage rod 43 and right-hand storage rod 44 are secured to any convenient surface such as wooden block 59 by screws 50, 50', 50" and 50'" as shown in FIG. 13. In FIG. 13, the screws are used in cooperation with the holes in enlarged mounting areas 49 and 52 to secure the storage rods 43 and 44 to wooden support block 59. It is to be understood that the storage rods 43 and 44 have to be secured to wooden support block 59 in an aligned manner and spaced appropriately to permit sliding cover 47 to cooperate with and to slide onto and off of the free end of leg 45 as shown in FIG. 13 in order to open and close storage device 30 such that continuous personal items may be inserted and removed from storage device 30.

Legs 45, 46, 48 and 51 can be of solid or tubular construction and can be of any desired cross-section, similar to storage device 10 as discussed supra, but are shown as being of circular cross-section in the figures. Storage device 30 can be made from any suitable material such as a polymer or metal.

A major advantage of all the embodiments of the inventive storage device is that a large number of continuous personal items such as bracelets, bangles, necklaces, rings and/or watches may be mounted on the storage device for storage and display. In addition, when it is desired to remove a particular item, it is not necessary to remove any other items to remove the desired item in contrast to many other prior art jewelry organizer designs. By way of example, the unique construction of the storage device of the invention permits free horizontal left and right movement of all of the mounted personal items such that the particular desired item may be isolated next to the closing mechanism. the closing mechanism is then actuated to open the storage device and the desired item is removed. Once the desired item has been removed, the closing mechanism may be closed. In this manner of operation, it is not necessary to remove more items than the one desired—thus saving a good deal of time and effort. In addition, since many of these personal items are rather fragile in nature, there is less chance of damage to the mounted personal items since only the desired one need be removed.

Figure 14:
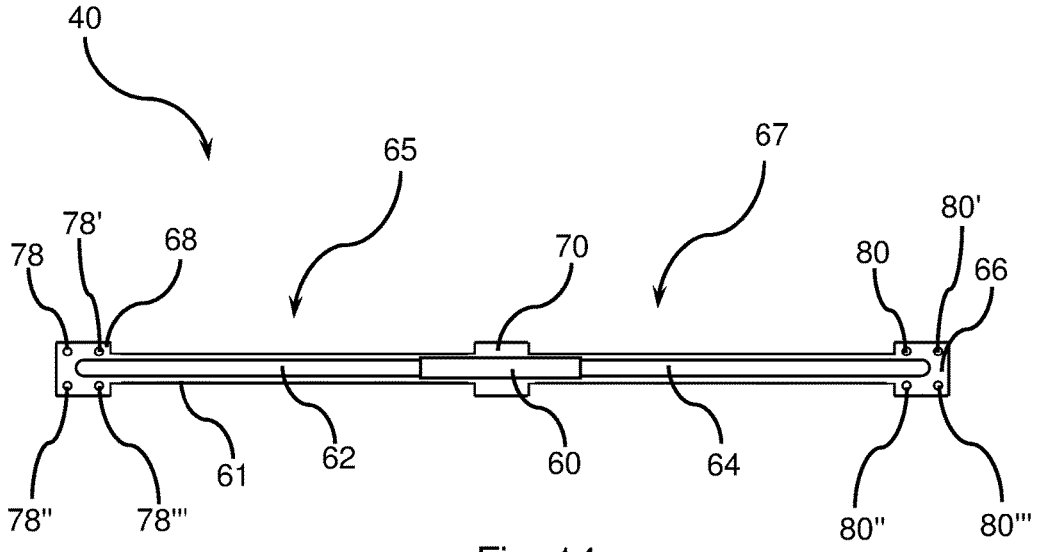
FIG. 14 is a plan view of a fourth embodiment of the invention.
Figure 15:
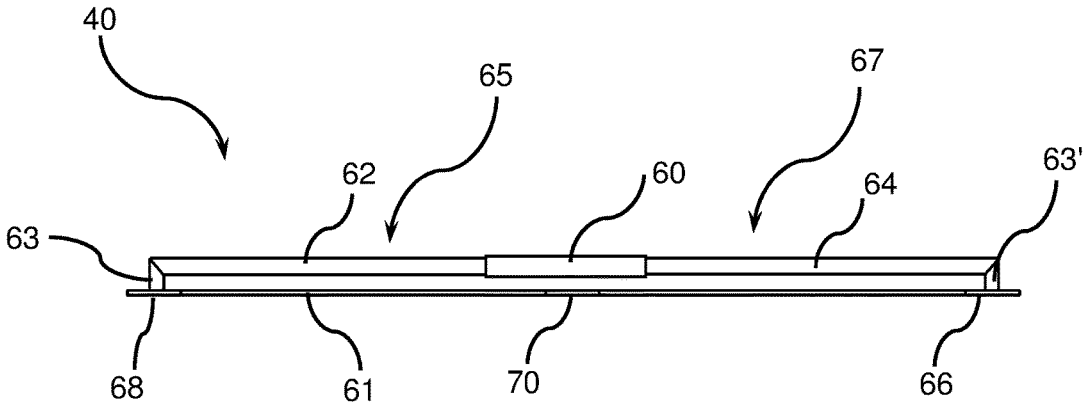
FIG. 15 is a side view of the embodiment of the invention shown in FIG. 14.
Figure 16:
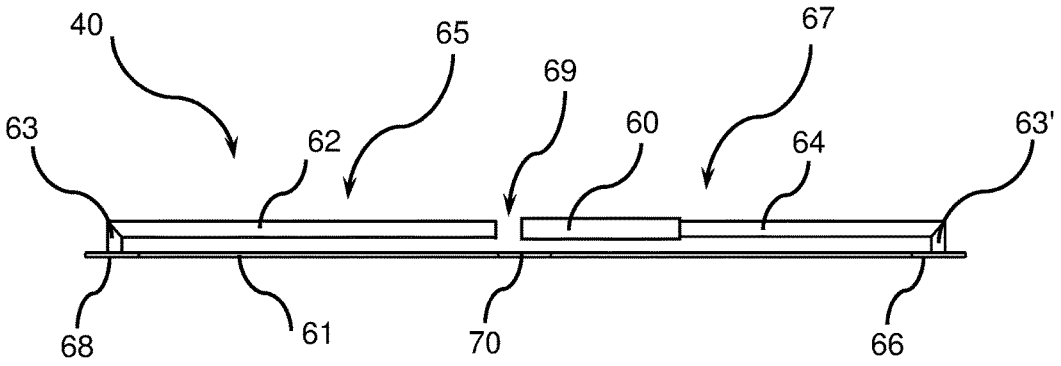
FIG. 16 is another side view of the embodiment of the invention shown in FIG. 14 with the sliding cover partially open.
Figure 17:
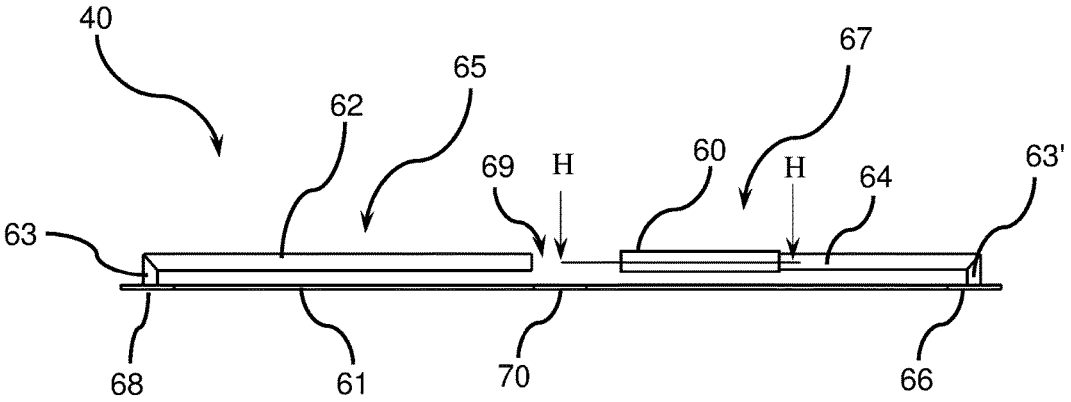
FIG. 17 is another side view of the embodiment of the invention shown in FIG. 14 with the sliding cover fully open to receive a piece of continuous jewelry such as a bracelet, bangle, ring or watch.

FIG. 14 shows a plan view of a fourth embodiment of the invention. FIGS. 15, 16 and 17 show a side view of the fourth embodiment of FIG. 14. The four figures will be described together since they all show the same embodiment. It is to be understood that not all of the elements described below are shown in each figure.

Storage device 40 comprises left-hand and right-hand generally "L"-shaped storage rods, 65 and 67 respectively. Left-hand storage rod 65 comprises a generally horizontal leg 62 and a generally vertical leg 63. Leg 63 is secured at one end to enlarged mounting area 68 with the other end thereof being joined to the left-hand end of horizontal leg 62. The right-hand end of horizontal leg 62 is freely supported. Right-hand storage rod 67 comprises a generally horizontal leg 64 and a generally vertical leg 63'. Leg 63' is secured at one end to enlarged mounting area 66 with the other end thereof being joined to the right-hand end of horizontal leg 64. Vertical legs 63' and 63 are securely fastened at the lower ends thereof to the upper surface of enlarged mounting areas 66 and 68, respectively, by welding or other conventional fastening processes. The upper end of vertical leg 63 is secured to the left end of horizontal leg 62 by welding or other conventional fastening means. The upper end of vertical leg 63' is secured to the right hand end of horizontal leg 64 The right-hand end of horizontal leg 62 and the left-hand end of horizontal leg 64 are freely supported. This provides a cantilever mounting for horizontal legs 62 and 64.

It should be noted that instead of having vertical legs 63 and 63' joined to horizontal legs 62 and 64 by welding or other conventional fastening means, the legs may be made of one continuous piece of tubing with a bend where the right-angle joint is shown in the Figures [this would be similar to the construction shown in FIGS. 2, 4 and 9]. For example, left-hand storage rod 65 could be made from a single continuous piece of tubing with a bend where the right angle joint between vertical leg 63 and horizontal leg 62 is currently shown. In similar fashion, right-hand storage rod 64 could also be made of a continuous piece of tubing with a bend.

Horizontal legs 62 and 64 do not extend to and meet in the center of storage device 40 and so provide an opening [not shown in FIGS. 14 and 15] through which a continuous personal item such as a bracelet, bangle, necklace, ring and/or watch may be mounted on storage rods 65 and 67. The closing mechanism for storage device 40 comprises a sliding cover 60 which is slidably secured to the free end of horizontal leg 64. Sliding cover 60 is a hollow cylinder whose inside diameter is slightly larger than the outside diameter of horizontal legs 62 and 64. Sliding cover 60 is secured to horizontal leg 64 but can slide to the left and right to open and close storage device 40. This sliding action is illustrated in FIGS. 16 and 17 wherein opening 69 is partially open in FIG. 16 and completely open in FIG. 17.

Storage device 40 also comprises support strip 61 with three enlarged mounting areas 66, 68 and 70 thereon. Mounting areas 66 and 68 are each shown [in FIG. 14] with multiple mounting holes 78, 78', 78", 78''', 80, 80, 80" and 80''' therein to receive screws so as to mount storage device 40 to a convenient surface such as a horizontal block or to a convenient vertical surface such as a closet door [not shown]. In addition, mounting area 70 has at least one hole for a mounting screw which is not shown in the figures.

Figure 18:
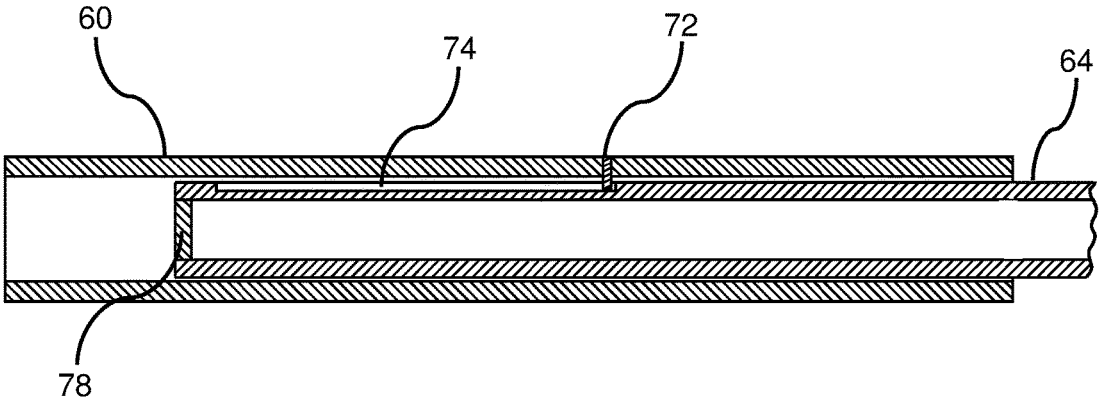
FIG. 18 is a cross section of the closing mechanism of the fourth embodiment taken along section H-H of FIG. 17.

FIG. 18 shows one manner in which cover 60 may be secured onto horizontal rod 64. FIG. 18 is a plan view taken along section H-H of FIG. 17. The elements of FIGS. 14-17 that are repeated in FIG. 18 carry the same numbering. Sliding cover 60 is shown in the fully open position [slid as far to the right as possible] in FIG. 18. Horizontal rod 64 is shown as a hollow tube in FIG. 18 closed at the left-hand end by plate 78 secured in the end of horizontal rod 64. Stopped slot 74 is milled or otherwise formed in the side wall of horizontal rod 64. Pin 72 is mounted in cover 60 and is carried in stopped slot 74 such that it can slide to the left or to the right but will retain cover 60 on horizontal rod 64. Thus, the interaction of pin 72 with the two ends of stopped slot 74 provide for the left-right sliding movement of cover 60 and also secure cover 60 to rod-like member 64.

Figure 19:
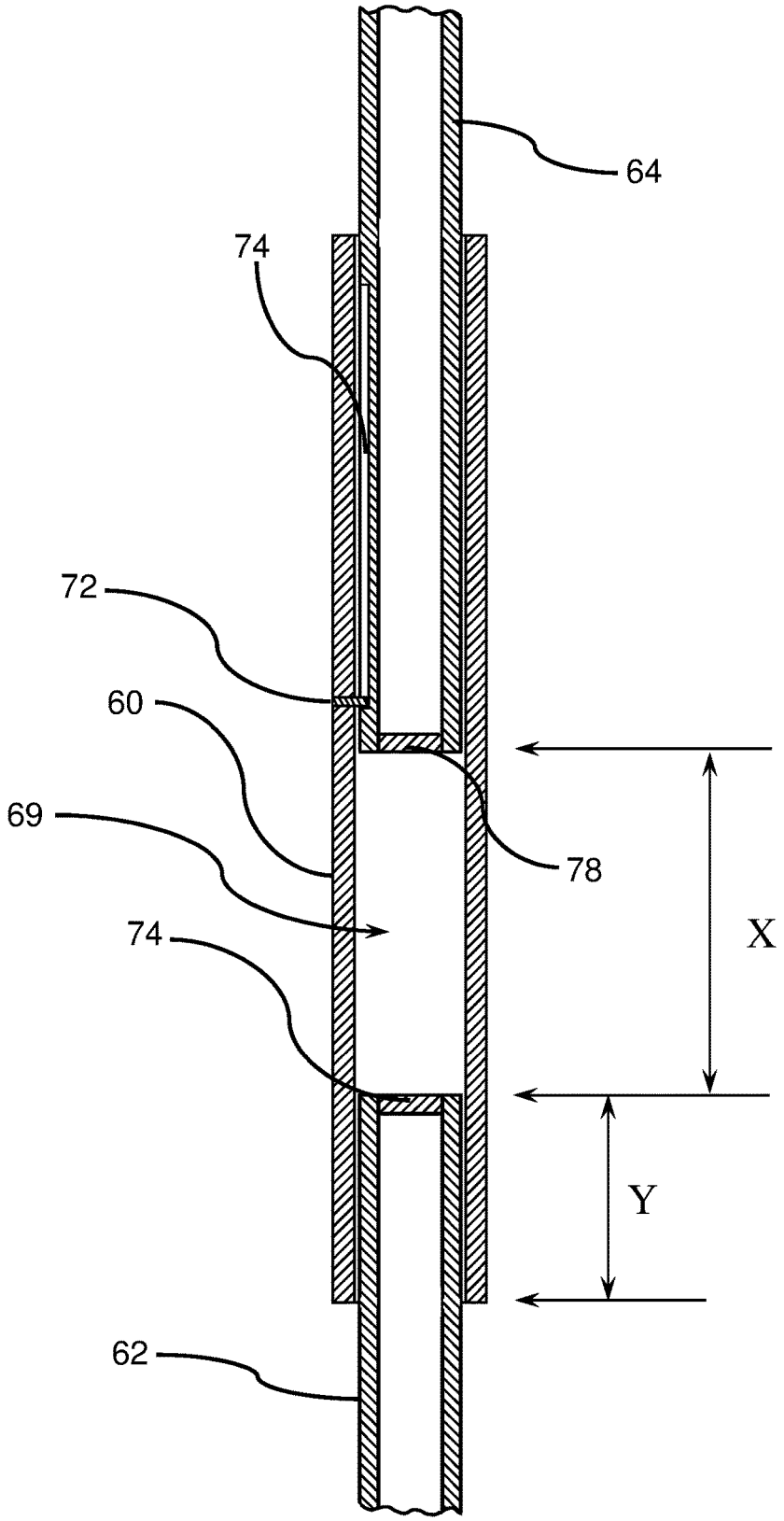
FIG. 19 is another partial sectional view of the embodiment of the invention shown in FIG. 17 along the section H-H showing the sliding cover fully closed and encompassing both portions of the rod-like storage device of the invention.

FIG. 19 is a sectional view taken along section H-H of FIG. 17. The elements of FIGS. 14-18 that are repeated in FIG. 19 carry the same numbering. Plate 74 is secured to and closes the right end of horizontal rod 62. Cover 60 is shown slid all the way down as shown in FIG. 19. In this position, cover 60 closes opening 69 such that items mounted on the storage device cannot fall off. It should be noted that pin 72 is now at the bottom end [in FIG. 19] of stopped slot 74. The bottom end [in FIG. 19] of cover 60 now encompasses the top [FIG. 19] end of horizontal rod 62 thus closing opening 69.

Distance X as shown in FIG. 19 shows the extent of opening 69. Distance X is such that when cover 60 is slid fully open as shown in FIG. 17, there is an opening of approximately 2 inches available to slip wide continuous items of jewelry on storage device 40 although this opening could obviously be greater or less than 2 inches, if desired. Distance Y as shown in FIG. 7 indicates how far cover 60 slides over the end of horizontal rod 62. This distance is shown as being equal to approximately two [2] diameters of horizontal rod 62 although distance Y could be more or less, if desired. It is important that cover 60 slide far enough onto horizontal rod 62 to secure the assembly together without excessive wobbling so that jewelry items may easily be placed upon and removed from storage device 40. The materials used to construct storage device 40 and the thicknesses of the various components are selected, again, to provide for a light-weight storage device yet to provide ample strength and rigidity when the unit is being manipulated. It is envisaged that storage device 40 will be constructed primarily of metal, although any other suitable material [such as a suitable polymer] may be used.

Figure 20:
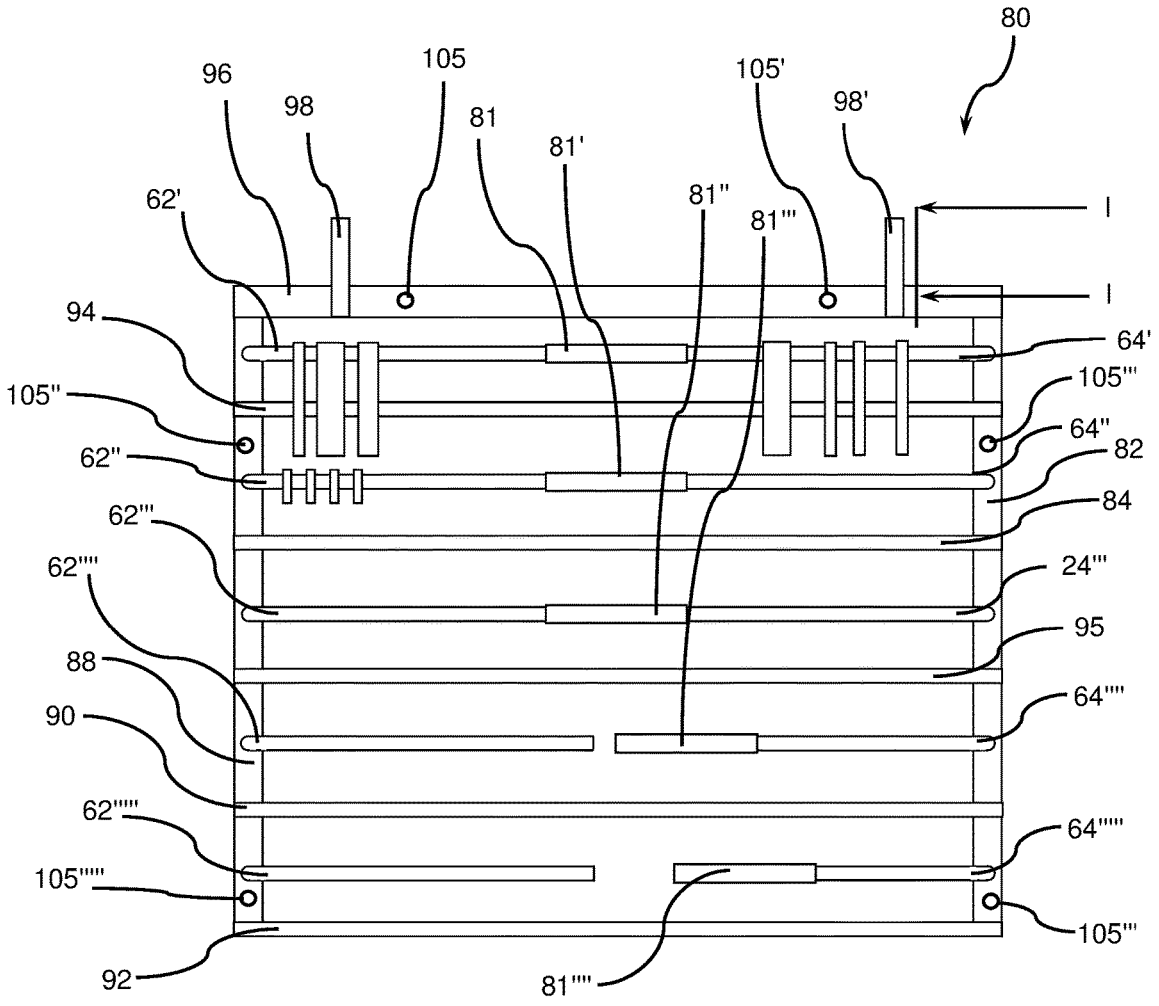
FIG. 20 is a side view of a fifth embodiment of the invention.

Device 80 as shown in FIG. 20 is a plan view of a fifth embodiment of the invention. Device 80 comprises multiple, "L"-shaped left-hand storage rod members 62', 62", 62''', 62'''' and 62''''' a vertical, strip-like member 88. Device 80 also comprises multiple, "L"-shaped right-hand storage rod members, 64', 64", 64''', 64'''' and 64''''' mounted on vertical strip-like member 82. Sliding covers 81, 81', 81", 81''' and 81'''' are mounted on the horizontal rod members 64', 64", 64''', 64'''' and 64''''' in a similar manner to that shown in FIGS. 18 and 19 to permit the covers to be slid to the right and/or the left to open and close the storage rod members so that continuous personal items may be slipped onto the storage rod members and stored/displayed thereon. Strip-like members 80 and 82 are joined at the upper end by a horizontal strip-like member 96 and also joined by spaced horizontal strip-like members 84, 90, 92, 94 and 95. The purpose of horizontal strip-like members 84, 90, 92, 94, 95 and 96 is to secure the assembly together without excessive wobbling such that jewelry items may be easily mounted on and removed from storage device 80 and such that the entire storage device 80 may be fastened to a convenient vertical surface such as a closet door or the like. To this end, hanging members 98 and 98' are secured to member 96 to permit storage device 80 to be hung over the top of a closet door. In addition, device 80 can be mounted to any suitable surface by emplacing suitable fasteners in fastener holes 105, 105', 105", 105''', 105'''', and/or 105'''''. A suitable fastener for fastening device 80 on a wooden surface might be wood screws [not shown in FIG. 20]. Other types of surfaces might call for other types of suitable fasteners although metal screws could be used to mount device 80 on a metal surface. It should be noted that when using the fastener holes to fasten device 80 onto a surface, hanging members 98 and 98' would probably need to be removed.

FIG. 20 shows several continuous bracelets [not numbered in the figures] and/or bangles mounted to storage rod member 62'. Several smaller items such as rings [not numbered in the figures] are shown as being mounted on storage rod member 62". It is obvious from FIG. 20 that a large number of continuous jewelry items can be easily stored and displayed on storage device 80. Because each storage rod member is closed at both ends, the items mounted on storage device 80 are secure and will not fall off the storage device. However, using a simple sliding movement of the various items mounted on the device and then opening the particular rod-like member where the item desired is located by sliding the cover to the right, a particular item may easily be removed without removing any of the other items.

Figure 21:
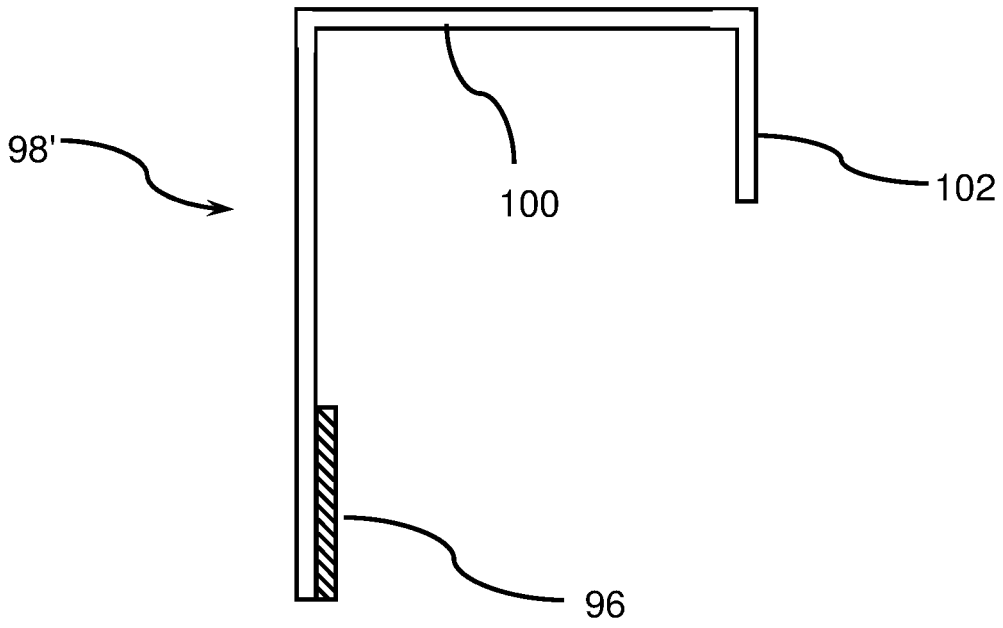
FIG. 21 is a view taken along section I-I of FIG. 20.

FIG. 21 shows a view of hanging member 98' as shown from the perspective of arrows I-I of FIG. 20. Hanging member 98' is secured to horizontal strip-like member 96 by any suitable fastening means [such as by welding, etc.]. Hanging member 98' has a horizontal portion 100 joined at the left end to the top end of vertical portion of member 98' and at the right end thereof to another vertical portion 102 which portion extends downwardly at substantially a right angle to horizontal member 100 as shown in FIG. 21. The length of horizontal member 100 is selected to be slightly greater that the thickness of a standard interior door. This construction will permit device 80 to be hung over the upper edge of a door such as a closet door such that device 80 may be mounted to the inside surface of a door for convenience. Hanging member 98 is constructed in substantially the same manner as hanging member 98'.

Many other configurations of the storage devices 10, 20, 30, 40 and 80 according to the invention are possible. The implementations described herein are only examples and other implementations are within the scope of the claims.

The invention claimed is:

1. A storage device and organizer for storing a plurality of personal items, comprising:

a first support member and a second support member;

a left-hand storage rod having a right-hand end and an opposite end, said opposite end of said left-hand storage rod being attached to said first support member, said right-hand end of said left-hand storage rod being free;

said right-hand end of said left-hand storage member having a securing portion;

a right-hand storage rod having a left-hand end and an opposite end, said opposite end of said right-hand storage rod being attached to said second support member, a movable locking device having a first end and a second end, said movable locking device having an open position for removal of items from said left-hand storage rod and said right-hand storage rod, said movable locking device having a closed position enabling sliding movement of items between said left-hand storage rod and said right-hand storage rod; and wherein said first end of said movable locking device is pivotably attached to said left-hand end of said right-hand storage rod;

said securing portion of said right-hand end of said left-hand storage member is adapted to receive said second end of said movable locking device;

and wherein said second end of said movable locking device is adapted to lock with said securing means when said second end of said movable locking device is received by said securing means, whereby said securing means cooperates with said right-hand end of said left-hand storage rod during opening and closing of said movable locking device; and wherein said first and said second support members are enlarged ends of a continuous strip.

2. The storage device of claim 1 wherein said securing device on said right-hand end of said left-hand storage rod includes a slot which is adapted to receive and removably secure said second end of said movable locking device.

3. The storage device of claim 2 wherein said movable locking device comprises a rod pivotably mounted to said left-hand end of said right-hand storage rod.

4. The storage device of claim 3 wherein said securing device further comprises an attachment means disposed in said slot formed in said right-hand end of said left-hand storage rod.

5. The storage device of claim 4 wherein said movable locking device comprises ferrous metal and said attachment means of said securing device further comprises a magnet mounted near said slot to magnetically hold said second end of said movable locking device in said slot.

6. The storage device of claim 1 wherein said first and said second support members have multiple holes bored therein adapted to receive screws so that said left-hand storage rod and said right-hand storage rod can be mounted on a support.

7. The storage device of claim 1 wherein said left-hand and right hand storage rods are each formed with a bend therein.

8. The storage device of claim 1 wherein said first support member is further attached to a first base member and said second support member is further attached to a second base member.

9. A storage device and organizer for storing a plurality of personal items, comprising:

a single support member is a continuous strip having a first enlarged end and a second enlarged end;

a left-hand storage rod having a right-hand end and an opposite end, said opposite end of said left-hand storage rod being attached to said first enlarged end of said single support member, said right-hand end of said left-hand storage rod being free;

said right-hand end of said left-hand storage member having a securing portion;

a right-hand storage rod having a left-hand end and an opposite end, said opposite end of said right-hand storage rod being attached to said second enlarged end of said single support member, a movable locking device having a first end and a second end, said movable locking device having an open position for removal of items from said left-hand storage rod and said right-hand storage rod, said movable locking device having a closed position enabling sliding movement of items between said left-hand storage rod and said right-hand storage rod; and wherein said first end of said movable locking device is pivotably attached to said left-hand end of said right-hand storage rod;

said securing portion of said right-hand end of said left-hand storage member is adapted to receive said second end of said movable locking device;

and wherein said second end of said movable locking device is adapted to lock with said securing means when said second end of said movable locking device is received by said securing means, whereby said securing means cooperates with said right-hand end of said left-hand storage rod during opening and closing of said movable locking device.

* * * * *